US006655165B1

(12) United States Patent
Eisenhour

(10) Patent No.: US 6,655,165 B1
(45) Date of Patent: Dec. 2, 2003

(54) AIR CONDITIONER WITH POWER RECOVERY DEVICE HAVING A SOUND SUPPRESSION DEVICE

(75) Inventor: Ronald S. Eisenhour, West Bloomfield, MI (US)

(73) Assignee: Nissan Technical Center North America, Inc., Farmington Hills, MI (US)

( * ) Notice: Subject to any disclaimer, the term of this patent is extended or adjusted under 35 U.S.C. 154(b) by 0 days.

(21) Appl. No.: 10/322,793

(22) Filed: Dec. 19, 2002

(51) Int. Cl.[7] ..... F25D 19/00

(52) U.S. Cl. ..... 62/296; 62/116; 181/224; 181/233

(58) Field of Search ..... 62/86, 87, 88, 62/116, 204, 222, 223, 224, 225, 210, 221, 296; 181/224, 233, 234, 403

(56) References Cited

U.S. PATENT DOCUMENTS

| | | | | |
|---|---|---|---|---|
| 2,327,542 A | | 8/1943 | Matteson | |
| 3,842,616 A | | 10/1974 | Orbesen | |
| 4,408,467 A | * | 10/1983 | Murnane et al. | 62/296 |
| 4,542,852 A | | 9/1985 | Orth et al. | |
| 4,621,677 A | * | 11/1986 | Suzuki et al. | 165/135 |
| 4,790,145 A | * | 12/1988 | Thompson et al. | 62/212 |
| 4,793,150 A | * | 12/1988 | Wattley et al. | 62/296 |
| 4,917,581 A | * | 4/1990 | Richardson et al. | 417/363 |
| 5,597,117 A | | 1/1997 | Watanabe et al. | |
| 6,272,871 B1 | | 8/2001 | Eisenhour | |
| 2001/0036414 A1 | * | 11/2001 | Makino et al. | 417/312 |

FOREIGN PATENT DOCUMENTS

| | | |
|---|---|---|
| JP | 61-96370 A | 5/1986 |
| JP | 4-340062 A | 11/1992 |
| JP | 11-63707 A | 3/1999 |

* cited by examiner

*Primary Examiner*—William E. Tapolcai
*Assistant Examiner*—Mohammad M. Ali
(74) *Attorney, Agent, or Firm*—Foley & Lardner

(57) ABSTRACT

An air conditioner has an evaporator, a main compressor, a condenser, and an energy recovery device. The condenser receives a compressed refrigerant from the compressor and condenses the refrigerant to either a liquid phase or a saturated liquid-vapor phase. The condensed refrigerant is passed through the energy recovery device to expand the refrigerant. The refrigerant passing through the energy recovery device is regulated to maintain the refrigerant in a high cavitation region within a motor, while maintaining within a predetermined refrigerant pressure range in the motor. During refrigerant regulation, sounds and vibrations are created that may be unpleasant to humans. A sound suppression device is included in the air conditioner to reduce or eliminate these sounds, and is positioned between the condenser and the energy recovery device.

36 Claims, 5 Drawing Sheets

AIR CONDITIONER WITH POWER RECOVERY DEVICE HAVING A SOUND SUPPRESSION DEVICE

CROSS-REFERENCE TO RELATED PATENT APPLICATIONS

The invention is related to the invention disclosed in U.S. Pat. No. 6,272,871, the contents of which are incorporated by reference herein in its entirety.

BACKGROUND OF THE INVENTION

A typical automobile air conditioner includes a compressor, a condenser, an expansion valve, and an evaporator. The compressor compresses a cool vapor-phase refrigerant (e.g., freon, R134a) to heat the same, resulting in a hot, high-pressure vapor-phase refrigerant. This hot vapor-phase refrigerant runs through a condenser, typically a coil that dissipates heat. The condenser condenses the hot vapor-phase refrigerant into liquid refrigerant. The liquid refrigerant is throttled through an expansion valve, which evaporates the refrigerant to a cold, low-pressure saturated liquid-vapor-phase refrigerant. This cold saturated liquid-vapor-phase refrigerant runs through the evaporator, typically a coil that absorbs heat from the air fed to the passenger compartment.

An automobile air conditioner consumes much engine power, which negatively impacts the acceleration performance and fuel economy. Attempts have been made to improve the air conditioner's efficiency by capturing some of the energy released by the hot, high-pressure refrigerant during the expansion stage, and applying the recovered energy toward compressing the cool vapor-phase refrigerant.

When a high-pressure, liquid refrigerant is throttled through an expansion valve or an orifice, it is transformed into a cold low-pressure saturated liquid-vapor-phase refrigerant, which is known as the "refrigeration effect." The throttling process itself does not fundamentally change the enthalpy (energy) content of the liquid-phase refrigerant. The liquid-phase to saturated liquid-vapor phase transformation, however, creates a boiling effect that liberates much kinetic energy, lowering the temperature of the refrigerant. The refrigerant's pressure drop from the high side to the low side and its subsequent expansion during cavitation (liquid-phase to saturated liquid-vapor-phase) provides an excellent opportunity to extract mechanical work. Further, extracting work from the refrigerant will enhance the refrigeration cycle performance, since the energy content of the refrigerant is reduced. It is desirable to capture this kinetic energy as much as possible.

In this regard, Japanese Patent publication Nos. 11-063707, 4-340062, and 61-96370, for example, disclose substituting the expansion valve with an expansion machine to capture part of the kinetic energy liberated during the throttling process. The expansion machine is essentially a motor driven by the hot, high-pressure liquid-phase refrigerant as it evaporates to a cold, low-pressure saturated vapor-phase refrigerant. A motor can include any device which produces energy resulting from the expansion of the refrigerant. The motor in turn is connected to a supercharger or compressor that can partially compress all or some of the cool vapor-phase refrigerant exiting from the evaporator, upstream of the compressor. The compressed refrigerant is fed through the compressor or fed to the condenser. Ideally, this should reduce the energy required to compress the refrigerant, thus making the air conditioner more efficient.

The present inventor had discovered that work can be best captured when the refrigerant is undergoing transformation from a liquid phase (or saturated liquid-vapor phase) to a saturated liquid-vapor phase having a higher vapor content, which occurs in a "high cavitation" region. Keeping the refrigerant in a high cavitation region within the motor, however, is difficult. The present inventor had discovered a way of maintaining the location of the high-cavitation region as the refrigerant is passed through an energy recovery device. The teachings of the present inventor's discovery can be found in U.S. Pat. No. 6,272,871, which is incorporated herein by reference in its entirety.

SUMMARY OF THE INVENTION

It is known that when fluid flow is suddenly started and/or suddenly stopped and/or suddenly restricted and/or suddenly increased, audible sounds and other vibrations are sometimes generated. These sounds may include but are not limited to a bang, a knock, a clunk, a clang, etc., and may also include multiple variations, combinations, and repetitions thereof. Generally, it is believed that the sounds and vibrations are a result of a pressure wave traveling down, say, a pipe or any other form of fluid conduit. This phenomenon is commonly referred to as water hammer. It is also believed that other sounds not commonly referred to as water hammer are generated when a fluid flow is suddenly started and/or suddenly stopped. It is also believed that suddenly restricted and/or suddenly increased flows generate sounds not commonly referred to as water hammer.

The present inventor has discovered that practicing the teachings of U.S. Pat. No. 6,272,871 can lead to the creation of sounds including but not limited to the sounds described above. It is believed that the sounds are related to maintaining the location of the high-cavitation region as the refrigerant is passed through the energy recovery device. Specifically, it is believed that the sounds result from the refrigerant flow stopping abruptly and/or slowing abruptly when the flow of refrigerant through the motor is regulated by the energy recovery device, and it is also believed that it is possible that the sounds result from the refrigerant flow slowing abruptly and/or increasing speed abruptly when the flow of refrigerant through the motor is regulated by the energy recovery device.

The present invention relates to an air conditioner comprising at least one evaporator that evaporates a cold refrigerant, at least one heat removal device adapted to receive compressed refrigerant and remove heat from at least a portion of the compressed refrigerant, at least one energy recovery device, wherein the energy recovery device comprises at least one motor, the at least one motor being in fluid communication with the at least one heat removal device and positioned downstream of the heat removal device and upstream of the evaporator, and a sound suppression device in fluid communication with the heat removal device and the motor and positioned upstream of the energy recovery device.

According to another aspect of the invention, the sound suppression device comprises a reservoir adapted to hold varying mass amounts of refrigerant.

According to another aspect of the invention, the reservoir is adapted to be filled and depleted with refrigerant.

According to another aspect of the invention, the reservoir is adapted to be filled and depleted with liquid refrigerant.

According to another aspect of the invention, the reservoir is a high-pressure reservoir.

According to another aspect of the invention, the sound suppression device comprises an orifice adapted to suppress sound resulting from operation of the energy recovery device.

According to another aspect of the invention, the sound suppression device comprises an orifice adapted to dampen a pressure pulse or a pressure wave propagating from a location at or upstream from the energy recovery device and downstream from the sound suppression device.

According to another aspect of the invention, the sound suppression device further comprises an orifice in fluid communication with the heat removal device and the reservoir.

According to another aspect of the invention, the orifice is positioned upstream of the reservoir.

According to another aspect of the invention, the orifice is integral with the reservoir.

According to another aspect of the invention, the energy recovery device is adapted to pulsatingly control the flow of refrigerant through the motor.

According to another aspect of the invention, refrigerant flow into the sound suppression device is continuous during steady-state operation of the air conditioner.

According to another aspect of the invention, refrigerant flow from the heat removal device is continuous.

According to another aspect of the invention, refrigerant flows into the sound suppression device after the refrigerant flow is substantially restricted from flowing to the motor.

According to another aspect of the invention, refrigerant flows into the sound suppression device after the refrigerant flow is substantially restricted from flowing from the motor.

According to another aspect of the invention, the sound suppression device is adapted to prevent a sudden increase in refrigerant pressure upstream from the energy recovery device when the energy recovery device pulsatingly controls the flow of refrigerant through the motor.

According to another aspect of the invention, energy of a pressure pulse created by the energy recovery device resulting from the energy recovery device pulsatingly controlling the flow of refrigerant through the motor is substantially reduced.

According to another aspect of the invention, the time for the pressure to rise at a location upstream from the energy recovery device and downstream from the heat removal device when the energy recovery device pulsatingly controls the flow of refrigerant through the motor is substantially extended.

According to another aspect of the invention, the sound suppression device reduces water hammer.

According to another aspect of the invention, the sound suppression device substantially reduces water hammer noise.

According to another aspect of the invention, the sound suppression device substantially absorbs a pressure pulse created when the energy recovery device pulsatingly controls the flow of refrigerant through the motor.

According to another aspect of the invention, the sound suppression device comprises a reservoir, wherein the reservoir is filled with refrigerant, the refrigerant being in at least one of a liquid and a liquid-vapor state.

According to another aspect of the invention, the sound suppression device comprises a pressure regulator.

According to another aspect of the invention, the sound suppression device decreases the rate of pressure increase of the refrigerant at a location upstream from the energy recovery device and downstream from the heat removal device as compared to the rate of pressure increase in an air conditioner without the sound suppression device.

According to another aspect of the invention, there is an air conditioner comprising an evaporator that evaporates a cold refrigerant to a vapor phase, a main compressor connected to the evaporator so that the compressor receives the vapor-phase refrigerant from the evaporator and compresses the vapor-phase refrigerant, a heat removal device connected to the compressor so that the heat removal device receives the compressed refrigerant from the compressor and removes heat from the refrigerant, an energy recovery device connected to the heat removal device and the evaporator so that the compressed and cooled refrigerant is passed through the energy recovery device, and a sound suppression device in fluid communication with the heat removal device and the energy recovery device and positioned upstream of the energy recovery device, wherein the energy recovery device includes, a motor located downstream of the heat removal device and upstream of the evaporator, and a regulator that passes the compressed and cooled refrigerant into the motor and maintains the refrigerant in the motor in a high cavitation region, while maintaining refrigerant within a predetermined refrigerant pressure range in the motor, wherein the regulator releases the refrigerant to the evaporator in a first saturated liquid-vapor phase having a higher vapor content than the refrigerant exiting the heat removal device.

According to another aspect of the invention, the regulator comprises a valve located adjacent the motor, the valve opening and closing flow of refrigerant through the motor, and a controller for opening and closing the valve based on the pressure of the refrigerant downstream of the motor and upstream of the evaporator to regulate the refrigerant flowing into the motor and maintain the refrigerant in a high cavitation region within the motor, while maintaining refrigerant within the predetermined refrigerant pressure range in the motor.

According to another aspect of the invention, there is a method of suppressing sound resulting from recovering energy from an air conditioner having an evaporator that evaporates a cold expanded refrigerant, a heat removal device adapted to receive compressed refrigerant from a compressor and remove heat from at least a portion of the compressed refrigerant, and an energy recovery device having a motor, the method comprising, providing a sound suppression device in fluid communication with the heat removal device and the energy recovery device and positioned upstream of the energy recovery device, passing the cooled refrigerant through the motor, regulating the flow of the refrigerant through the motor and maintaining the refrigerant in a high cavitation region within the motor, and suppressing sounds resulting from the regulation of the flow of the refrigerant.

According to another aspect of the invention, the sounds are suppressed by dampening pressure pulses or pressure waves resulting from the regulation of the flow of the refrigerant.

According to another aspect of the invention, the sounds are suppressed by enabling flow into the sound suppression device to be continuous.

According to another aspect of the invention, the sounds are suppressed by enabling flow into the sound suppression device to continue after the flow through the motor is restricted.

According to another aspect of the invention, the rate of pressure increase of the refrigerant at a location upstream from the energy recovery device and downstream from the heat removal device is decreased as compared to the rate of pressure increase in an air conditioner without the sound suppression device.

According to another aspect of the invention, the sounds are suppressed by enabling flow from the heat removal device to be substantially continuous.

According to another aspect of the invention, the sounds are suppressed by preventing a sudden increase in refrigerant pressure upstream from the energy recovery device when the flow of refrigerant is regulated.

According to another aspect of the invention, there is an air conditioner comprising, at least one evaporator that evaporates a cold refrigerant, at least one heat removal device adapted to receive compressed refrigerant and remove heat from at least a portion of the compressed refrigerant, at least one flow restriction device adapted to abruptly decrease the flow of refrigerant from the heat removal device towards the evaporator at at least one location between the heat removal device and the evaporator, and a sound suppression device in fluid communication with the heat removal device and the evaporator and positioned upstream of the flow restriction device and downstream of the heat removal device.

According to another aspect of the invention, refrigerant flows into the sound suppression device after refrigerant flow is substantially restricted from flowing towards the evaporator.

According to another aspect of the invention, the sound suppression device is adapted to prevent a sudden increase in refrigerant pressure upstream from the flow restriction device when the flow restriction device restricts the flow of refrigerant towards the evaporator.

According to another aspect of the invention, energy of a pressure pulse created by the flow restriction device resulting from the flow restriction device restricting the flow of refrigerant towards the evaporator is substantially reduced.

According to another aspect of the invention, the time for the pressure to rise at a location upstream from the flow restriction device and downstream from the heat removal device when the flow restriction device restricts the flow of refrigerant towards the evaporator is substantially extended.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

DETAILED DESCRIPTION OF THE PREFERRED EMBODIMENTS

Figure 1:
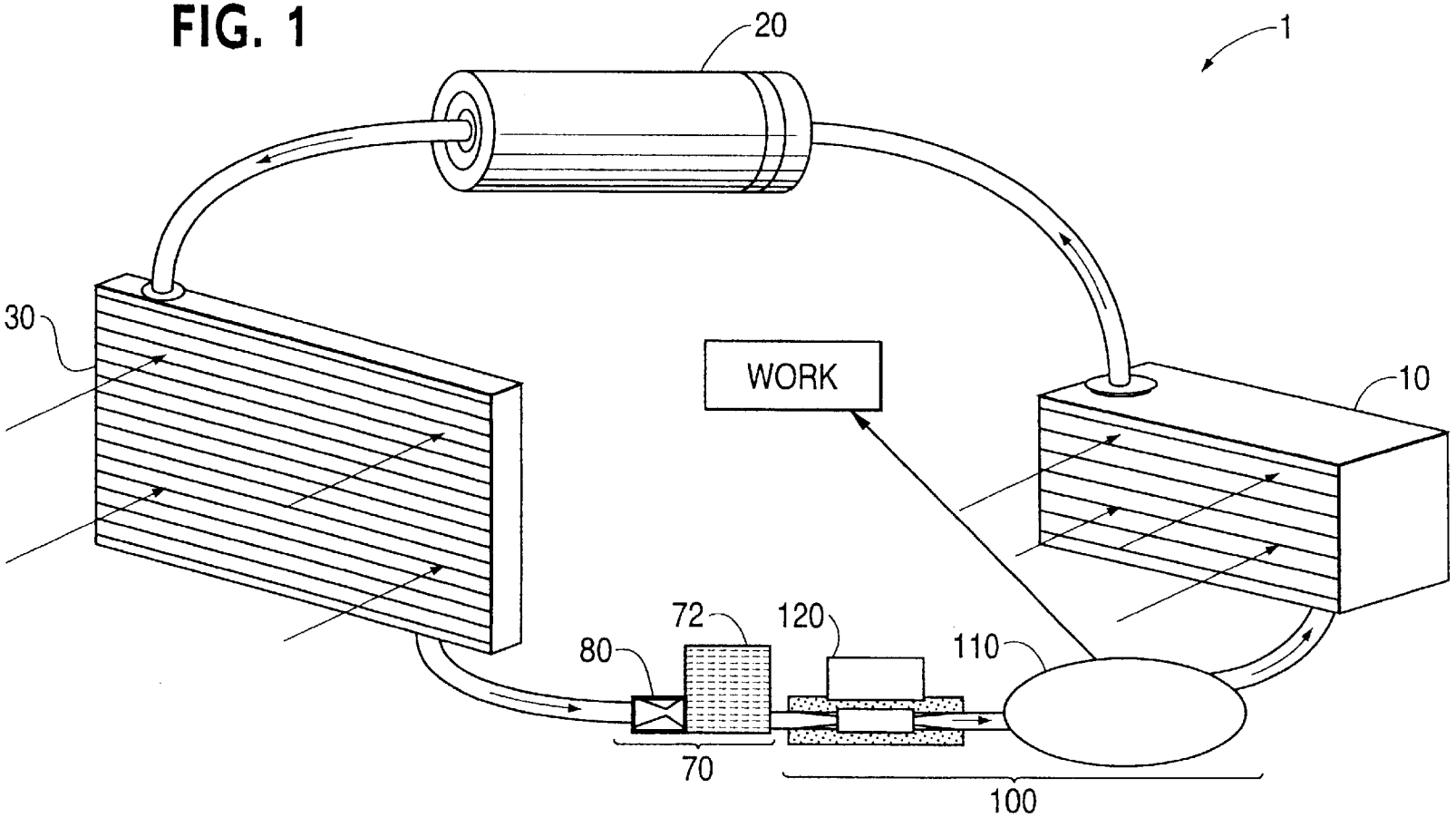
FIG. 1 schematically illustrates a refrigerant circuit with a sound suppression device according to the present invention.

Referring to FIG. 1, an air conditioner 1 according to the present invention, which is particularly suitable for an automobile or other passenger vehicle (such as but not limited to a car, an SUV, a minivan, a station wagon, a pick-up truck, etc.,) as well as refrigeration systems for homes and industrial use, includes an evaporator 10, a compressor 20, a heat removal device which in the preferred embodiment is a condenser 30, an energy recovery device 100, and a sound suppression device 70. The compressor 20 is connected to the condenser 30 via a refrigerant pipe or duct. The evaporator 10 is also connected to the compressor 20 via a refrigerant pipe. The energy recovery device 100 is connected to the sound suppression device 70 via a refrigerant pipe and to the evaporator 10 by a refrigerant pipe. However, the present invention can be practiced with the sound suppression device 70 directly connected to the energy recovery device 100 without the need of a refrigerant pipe in between. The sound suppression device 70 is connected to the condenser 30 via a refrigerant pipe, although it may also be directly connected to the condenser 30 without a pipe. The compressor 20 receives and compresses a cool vapor-phase refrigerant (e.g., freon, R134a) from the evaporator 10. The compression action heats the refrigerant, resulting in a hot, high-pressure vapor-phase refrigerant. This hot vapor-phase refrigerant runs through the condenser 30, such as an air-cooled coil that dissipates heat. The condenser 30 condenses the hot vapor-phase refrigerant into a liquid-phase refrigerant or a saturated liquid-vapor-phase refrigerant. In the preferred embodiment of the present invention, the condenser 30 condenses the refrigerant through cooling. Thus, the condenser of the preferred embodiment is a heat removal device. It is noted that the present invention can be configured to utilize refrigerant that does not need to be cooled to a liquid-phase, such as by way of example and not by way of limitation, carbon dioxide.

The condensed refrigerant is delivered (preferably with very little pressure drop) through the sound suppression device 70 to the energy recovery device 100, which expands the liquid-phase or saturated liquid-vapor-phase refrigerant to a cold, low-pressure liquid-vapor-phase refrigerant having a higher vapor content, and captures a portion of the kinetic energy released during the expansion process. The cold liquid-vapor-phase refrigerant (having a higher vapor content than the refrigerant exiting the condenser) runs through the evaporator 10, typically a coil that absorbs heat from and cools the air delivered to the passenger compartment.

The refrigerant undergoes three states during the transition from the high pressure side to the low pressure side: liquid or saturated liquid-vapor (having a lower vapor content), high cavitation, and saturated liquid-vapor (having a higher vapor content). In the liquid state (or saturated liquid-vapor phase having a high liquid content), the refrigerant mimics hydraulic behavior (low volumetric flow rate in a single phase). In the high-cavitation state, a small liquid volume expands to a large vapor volume. In the saturated liquid-vapor state having a higher vapor content, the refrigerant behaves like a gas (complete phase transition with a high volumetric flow rate). As mentioned above, the work can be best derived while the refrigerant is in the high cavitation state. Attempts to extract energy from the other phases can effectively impede flow and yield very little net benefit.

Keeping the high-cavitation state (phase change region) located in a turbine/motor 110 is difficult, but by pulsing or modulating a valve 120, e.g., a solenoid valve, with a low-pressure drop, the phase on either side of the valve can be influenced. Closing the valve can maintain a liquid and vapor boundary located at the motor. Thus, by pulsatingly controlling the flow of refrigerant through the motor, the boundary can be maintained.

FIGS. 2–7 show various embodiments of the sound suppression device 70 along with the energy recovery device 100 according to the present invention. In these embodiments, the sound suppression device 70 includes a reservoir 72 in fluid communication with an orifice 80. In the embodiments seen in the Figs., the orifice 80 is positioned upstream of the reservoir 72 and the reservoir is positioned upstream of the energy recovery device 100, although the orifice 80 could be positioned downstream of the reservoir as well.

A preferred embodiment of the reservoir 72 comprises a high pressure reservoir comprising an upright cylinder made from an aluminum tube or an aluminum pipe with aluminum plates welded to the top and bottom of the tube or pipe to close the open ends, thus preventing refrigerant from escaping from the reservoir. It is noted that it is not necessary that the cylinder be upright, as it could be positioned on its side or at an angle to practice the present invention. Also, other materials can be used to form the reservoir 72, such as steel, and the ends of the tube or pipe can be sealed using other appropriate means, such as a threaded cap. Further, the reservoir 72 is not limited to a cylindrical configuration or any specific configuration, as any appropriate reservoir geometry can be used to practice the invention. By way of example only and not by limitation, a square-shaped or rectangular-shaped, or spherical-shaped reservoir can be used. Indeed, even a bulge in a pipe can be used to serve as a reservoir, providing that it serves to allow the physical phenomenon of suppression of the sound from the energy recovery device to occur.

The preferred embodiment of the reservoir 72 is a high pressure reservoir. To this end, it is preferred that the reservoir be of a construction (size, shape, material, thickness, etc.) to withstand the pressures resulting from the refrigerant. However, reservoirs that are not high pressure reservoirs may be used as well providing that the reservoir is adapted to withstand the internal pressures resulting from the refrigerant. By way of example only and not by limitation, a low pressure reservoir could be structurally supported in a manner (eg. such as with clamps or straps or welds) to withstand the pressures resulting from the refrigerant. Basically, a reservoir that will withstand a pressure of about 350 psig or more can be used to practice the present invention, although the present invention can be practiced with reservoirs having a pressure capacity of less than 350 psig and reservoirs having a pressure capacity greater than 350 psig. By way of example only and not by limitation, it is believed that reservoirs having pressure capacities of less than 1 psig to greater than 1000 psig and any pressure capacity or range of pressure capacity of a reservoir in between in 0.1 psig increments can be used.

The reservoir 72 of the preferred embodiment includes one or more refrigerant inlet holes and one or more refrigerant outlet holes in the lower portion of the reservoir 72, the holes being substantially aligned with and opposed from one another. However, the present invention can be practiced with the holes not aligned with and/or not opposed from one another, as well as one or more or all the holes being positioned in another location other than the lower portion of the reservoir. In the preferred embodiment, the holes are substantially identical in size and shape, the preferred shape being round, and a diameter of about 0.075 inches, although other embodiments can be used with a smaller diameter orifice, such as about 0.050 inches, and a larger diameter orifice, such as about 0.10 inches (by way of example only and not by limitation, it is believed that orifices having diameters of less than about 0.03 inches to greater than about 0.2 inches and any diameter or range of diameters in between in 0.001 inch increments can be used). However, the present invention can be practiced with holes that are not identical in size and shape, and holes that are of a geometry other than round (for example but not for limitation: square, octagonal, rectangular, oval, etc.). It is also noted that it is not necessary to have a symmetrical distribution of the holes. That is, by way of example and not by limitation, the present invention could be practiced with a reservoir having two inlet holes and one outlet hole, or visa-versa. Finally, the present invention can be practiced with a reservoir having inlet holes configured such that the combined total cross-sectional area of the inlet holes is different than that of the combined total cross-sectional area of the outlet holes.

The reservoir of the preferred embodiment has a 20–25 ml internal volume, although the present invention can be practiced with reservoirs having an internal volume less than 20–25 ml and reservoirs having an internal volume greater than 20–25 ml. By way of example only and not by limitation, it is believed that reservoirs having internal volumes of less than 1 ml to more than 1000 ml and any size or range of size of reservoir in between in 0.1 ml increments can be used. Reservoirs of variable volumes can be acceptable to practice the present invention as well, but may or may not need to be matched to the refrigeration system sizing to meet the flow requirements of containing liquid at the time of valve closure in the high load/high refrigerant flow conditions.

As noted above, a preferred embodiment of the present invention also includes an orifice 80 positioned upstream of the reservoir and upstream of the energy recovery device such that the orifice feeds the reservoir with refrigerant. The orifice of the present invention is constructed such that the cross sectional area provided for fluid flow in the orifice is smaller than the cross sectional area provided for fluid flow in the pipes or fluid conduits leading from the condenser to the orifice. In the preferred embodiment, the orifice 80 is machined into an aluminum block into which a pipe from the condenser and a pipe to the reservoir are fitted. The fitting can be accomplished by threading the pipes into the block, or welding the pipes to the block. Basically, any means of attaching the pipes to the block are sufficient as long as the orifice is in fluid communication with the condenser and the reservoir. However, the orifice of the present invention is not limited to a hole machined into an aluminum block. By way of example and not by limitation, a washer-type orifice can be placed into one of the pipes. Further by way of example and not by limitation, a washer-type orifice can be placed in between two pipes, the pipes being connected to the orifice or being connected by a pipe connector, the orifice being inside the connector. It is further noted that other material can be used to make the orifice, such as steel.

The orifice of the preferred embodiment has a circular hole through the center of the orifice. However, it is not necessary that the hole be circular or in the center. By way of example and not by limitation, a square, rectangular, or oval shaped hole can be placed in the orifice. Further, the present invention can be practiced with a hole that is not in the center of the orifice or the center of the fluid flow.

Additionally, it is noted that the orifice may have more than one hole, and that the holes do not have to be similar in size or shape or even symmetrical about any given axis. Basically, any orifice that serves to allow the physical phenomenon of suppression of the sound from the energy recovery device to occur can be used to practice the present invention. The exact size of the hole through the orifice is variable depending on a variety of factors including but not limited to the desired mass flow rate of the refrigerant. In one embodiment of the present invention, an orifice with a hole having a diameter of 0.075 inches is used. The exact length of the orifice is likewise variable, and in one embodiment of the present invention the length is roughly 0.1 inches. A standard orifice tube can be used to practice the invention as well.

The energy recovery device 100 can include a pneumatic turbine/motor 110 and a solenoid operated valve 120, and a pressure sensor 130 or switch 130' positioned downstream of the motor 110 and upstream of the evaporator 10. The solenoid valve 120 can be, for instance, Model No. RB3P2 manufactured by PARKER. The motor 110 can be, for instance, ¾ HP air motor Model No. 2AM-NCC-16, manufactured by GAST. This air motor provides a basic internal structure schematically illustrated in FIGS. 2–7.

This air motor, by design, does not seal exceptionally well internally or externally. Thus, to properly contain refrigerant, additional sealing is applied to the bearings and housing seams. The internal leakage (blow-by) compromises the efficiency of power recovery, in that some refrigerant will bypass the turbine. Due to this effect, this motor cannot be useful in modulation of refrigerant flow and will act as an orifice when turbine rotation is stopped. (This leakage provides the function to allow refrigerant flow to the evaporator when the expander/motor is coupled to a compressor that is not operating. Thus, cooling performance can be satisfied without the demand to have the compressor running.) As a countermeasure to the imperfection of the motor internal sealing, the solenoid valve 120, which safely maintains a high-pressure level (up to 350 psig) at the inlet of the motor, is used. The solenoid valve 120 is used to modulate the refrigerant flow and can maintain a pressure of around 40 psig at the outlet of the motor. This way, the blow-by effect advantageously does not disable the power recovery function, since a large pressure drop across the motor is kept.

Figure 2:
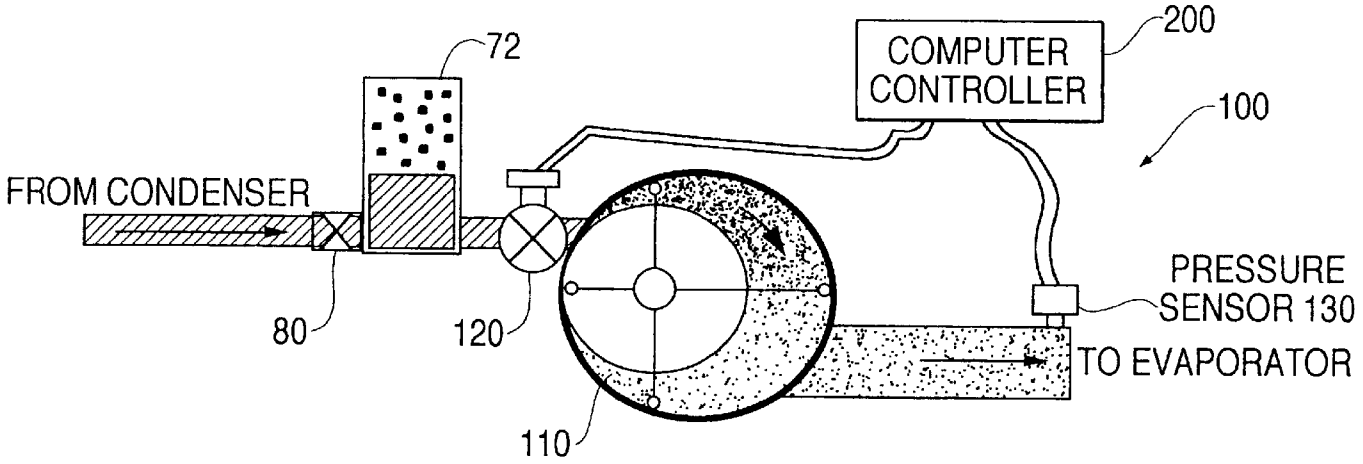
FIG. 2. schematically shows one embodiment of the sound suppression device according to the present invention with the solenoid valve in the open state.
Figure 3:
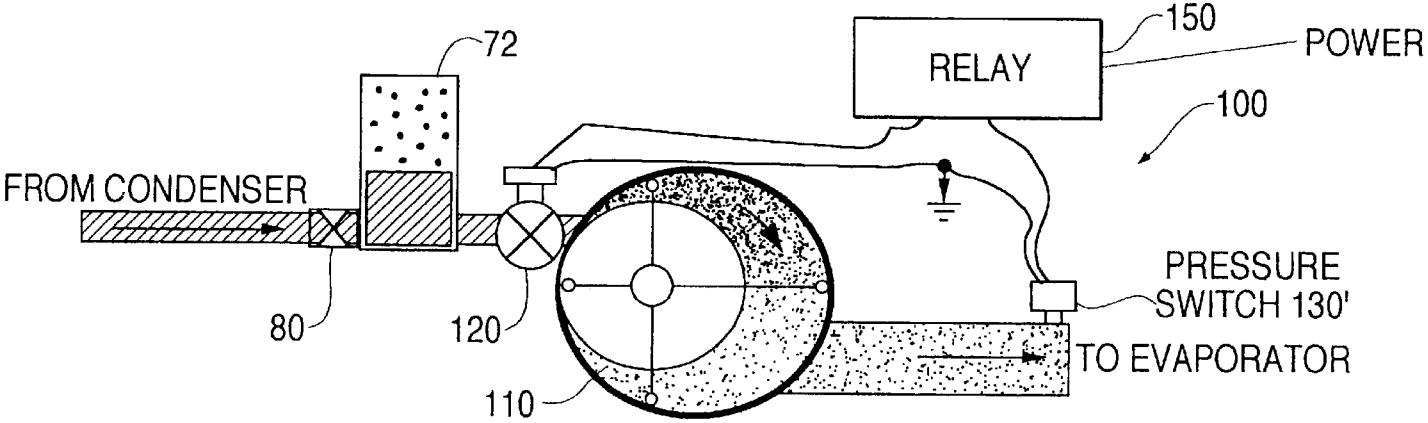
FIG. 3. schematically shows another embodiment of the sound suppression device according to the present invention with the solenoid valve in the open state.
Figure 4:
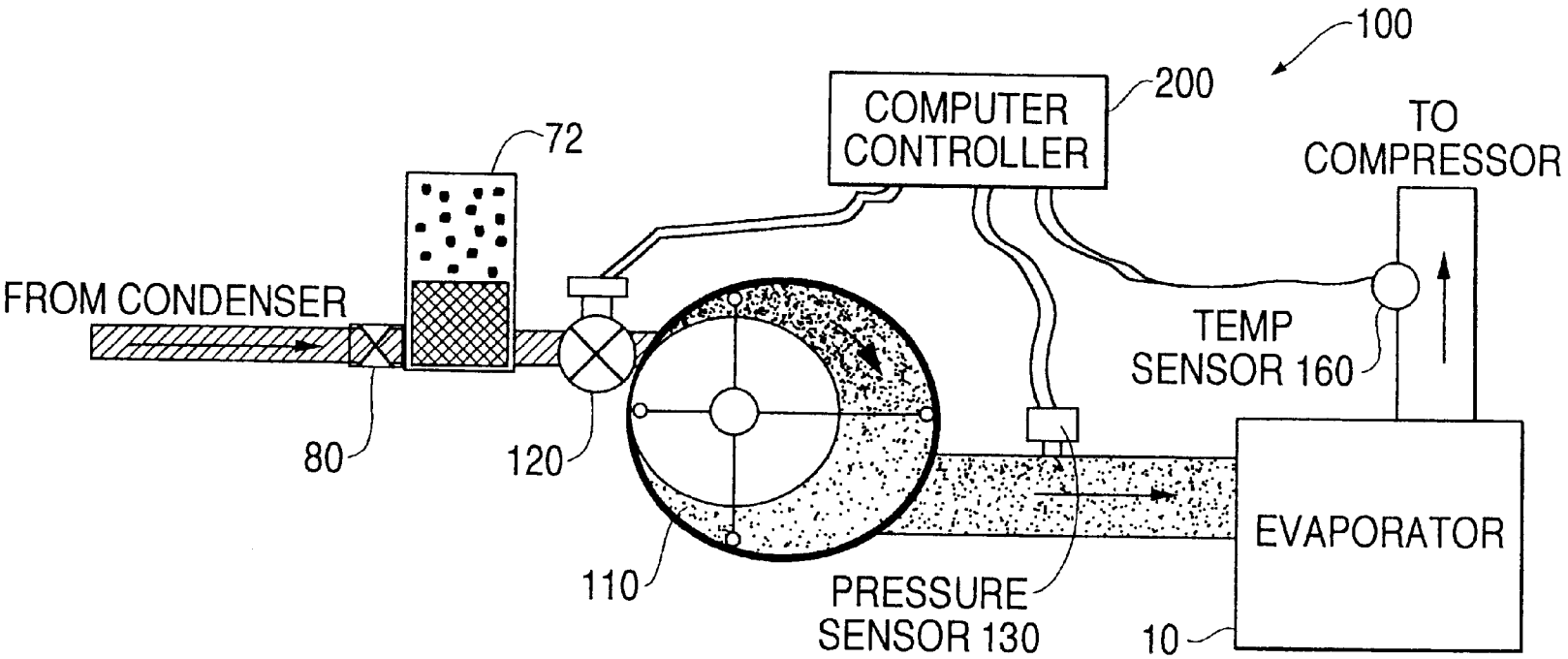
FIG. 4. schematically shows yet another embodiment of the sound suppression device according to the present invention with the solenoid valve in the open state.
Figure 5:
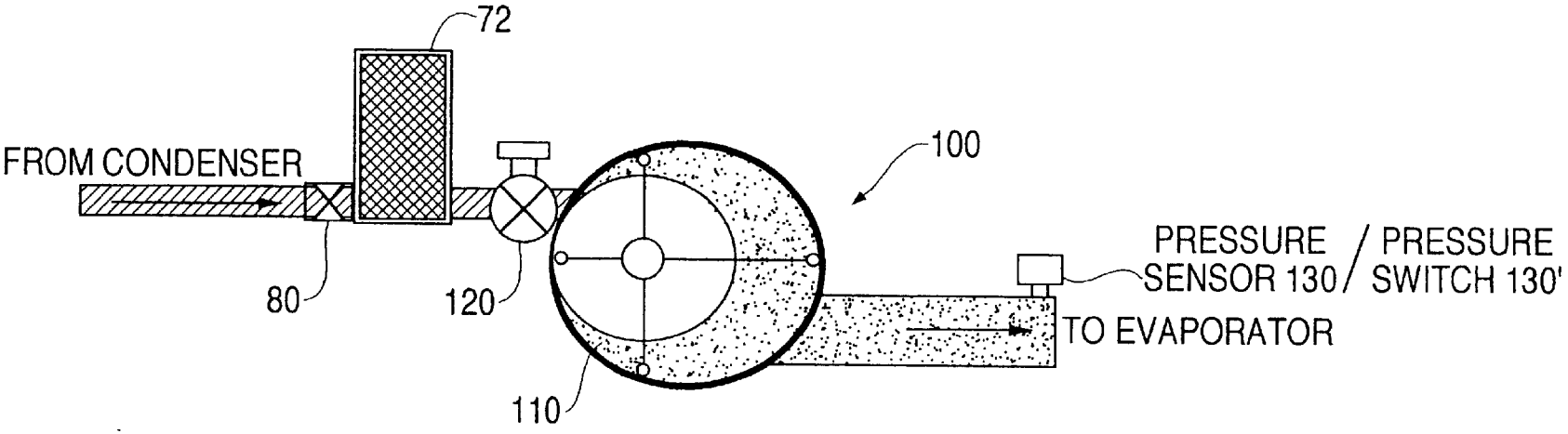
FIG. 5. schematically shows the noise suppression device of FIGS. 2–4, while the solenoid valve is in the closed state.
Figure 6:
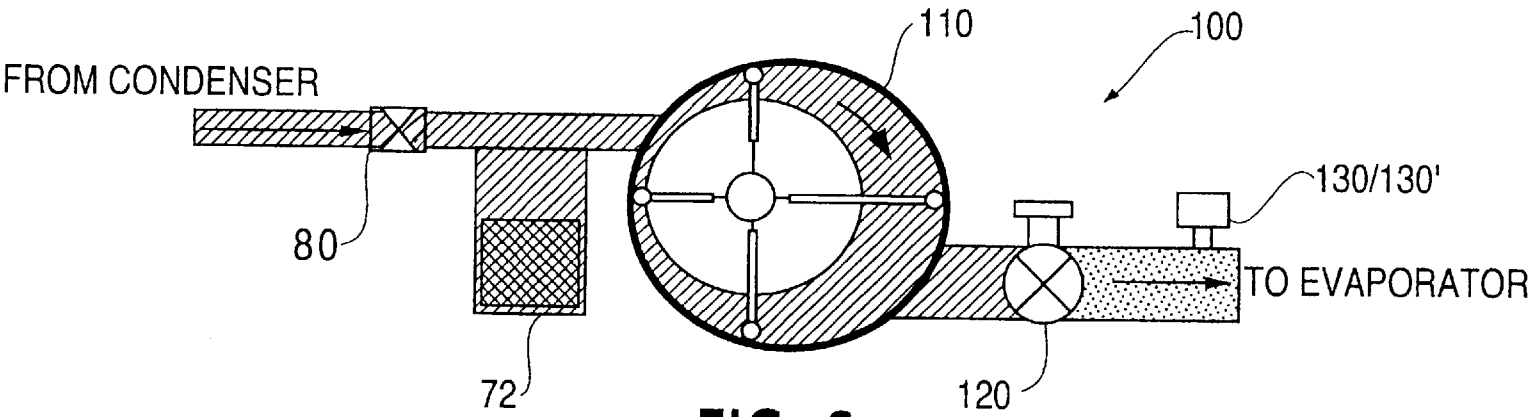
FIG. 6. schematically shows yet another embodiment of the sound suppression device according to the present invention with the solenoid valve in the closed state.
Figure 7:
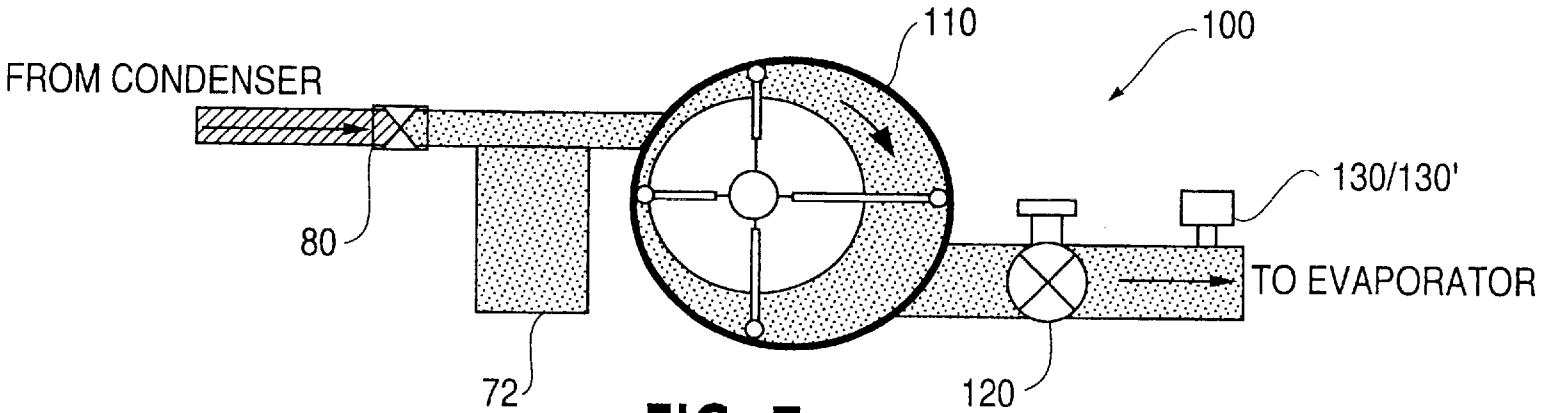
FIG. 7. schematically shows yet another embodiment of the sound suppression device according to the present invention with the solenoid valve in the open state.

The pressure sensor 130 or switch 130' can be used to control the opening and closing of the solenoid valve 120. In the embodiments of FIGS. 2 and 4, a computer controller 200 is used with a pressure sensor 130 to control the solenoid valve 120. In the embodiment of FIG. 3, a power relay 150 and the pressure switch 130' are used to control the opening and closing of the solenoid valve 120. In the embodiment of FIGS. 6–7, either the power relay or the computer controller 200 is used as in the embodiments of FIG. 3 or FIGS. 2 and 4. For instance, the solenoid valve 120 can be operated with a 24 VAC coil with a 12 VDC (or the voltage of the automobile) and a pressure switch 130', which can be a conventional pressure cycling switch available from VISTEON. In the embodiment of FIG. 4, an additional temperature sensor 160 can be included to take into consideration the evaporated refrigerant condition. The temperature sensor 160 monitors the temperature of the refrigerant exiting the evaporator 10.

In the embodiments of FIGS. 2–5, the solenoid valve 120 is positioned immediately upstream of the motor 110. The solenoid valve 120 acts as a shut-off valve rather than an expansion valve, due to a low-pressure drop when it is open. In the embodiment of FIGS. 6–7, the solenoid valve 120 is positioned immediately downstream of the motor, but upstream of the pressure sensor 130 or switch 130'. It is noted that FIGS. 6–7 show that a substantial part of the reservoir is below the flow from the condenser, as opposed to above the flow from the condenser as seen in the previous FIGS. In this configuration, the flow of liquid refrigerant into the motor after the valve 120 is closed is prevented or at least reduced. It is noted that the embodiments described above and described below can include a reservoir that is positioned such that a substantial part of the reservoir is below the flow from the condenser, and that the embodiment shown in FIGS. 6–7 can have a reservoir that is positioned such that a substantial part of the reservoir is above the flow from the condenser.

The present embodiments thus present two approaches: upstream and downstream configurations, both of which are usable with the noise suppression device. The upstream configuration, e.g., the embodiments of FIGS. 2–5, feeds liquid (or highly liquid) refrigerant to the motor. The motor is kept at a low pressure, e.g., <40 psig, when the solenoid valve 120 is closed. When the solenoid valve 120 is opened, liquid or saturated liquid-vapor-phase refrigerant (having a high liquid content) may flood into the motor 110 and begin cavitation within the motor 110. If the flooding continues, the phase transition will pass through the motor and hydraulic effects will dominate. The object is to avoid the hydraulic effects by opening and closing (i.e. modulating the valve 120). The downstream configuration can create high-pressure refrigerant within the motor when the valve is closed or substantially restricted, depending on the length of time that the valve is closed or substantially restricted, thus the motor of this embodiment should be of a configuration to withstand high pressures. A source flow restriction is created to ensure that opening of the valve 120 will create cavitation within the motor 110. If the restriction is not applied, liquid will flood through the motor 110, creating the undesirable hydraulic effects.

As note above, the operation of the energy recovery device 100 can lead to the creation of sounds or other vibrations, including but not limited to "water" hammer, that may be unpleasant to humans when the energy recovery device 100 is operated without a sound suppression device. It is believed that the sounds result from the refrigerant flow stopping abruptly and/or slowing abruptly when the flow of refrigerant through the motor is regulated by the energy recovery device, but it is also believed that it is possible that the sounds result from the refrigerant flow starting abruptly and/or increasing speed abruptly when the flow of refrigerant through the motor is regulated by the energy recovery device. Specifically, it is believed that the sounds are directly related to the closing and opening of the solenoid valve of the preferred embodiment of the present invention, as the solenoid valve abruptly slows and increases and stops and starts the refrigerant flow. In any event, regardless of which component of the energy recovery device causes the sound, when the flow is regulated by pulsatingly controlling the flow of refrigerant into the motor of the energy recovery device, sounds occur, and the sound suppression device suppresses the sound, although it is noted that the present invention can be practiced without suppressing all of the sound.

It is believed that one of the physical phenomenon that causes sound when the energy recovery device is operated without the sound suppression device is a pressure pulse and/or a shock wave propagating from the energy recovery device upstream towards the condenser. It is further believed that in general this sound is related to an increase in pressure and specifically to an abrupt or sudden increase in pressure upstream from the valve of the preferred embodiment when the valve begins to close or is closed when the energy recovery device pulsatingly controls the flow of refrigerant through the motor. Therefore, it is believed that the pressure pulse propagates upstream from a location at or upstream from the energy recovery device. Thus, the sound suppression device of the current invention can prevent the pressure pulse and/or shock wave from being created, or at least substantially reduces the energy associated with the pressure pulse and/or shock wave in comparison to a pressure pulse and/or shock wave generated from the energy recovery device without the sound suppression device. By way of example only and not by way of limitation, the energy associated with the pressure pulse and/or shock wave could include kinetic energy, and can also be any resulting physical property of the pressure pulse and/or shock wave that creates the above mentioned sound. The sound suppression device can act to absorb the energy associated with the pressure pulse and/or shock wave as well.

The present invention reduces the sound generated by the energy device. It is believed that the sound is reduced because the sound suppression device permits the refrigerant to continue to flow from the condenser towards (either literally or in terms of fluid communication distance) the energy device for a sufficient period of time after the energy device stops or restricts flow through the motor during at least (but not limited to) state operation of the air conditioner. That is, the flow gradually stops, as opposed to abruptly stopping. Further, the flow can be continuous during steady-state operation of the air conditioner as well. It is also believed that the just mentioned phenomenon increases the time for the pressure to increase upstream of the energy recovery device. The reason that the flow is allowed to continue is explained below.

In the preferred embodiment, the reservoir is not filled to capacity with liquid refrigerant immediately prior to a restriction in fluid flow through the motor, as seen, for example but not for limitation, in FIG. 2. However, it is noted that the reservoir is preferably filled to capacity or substantially to capacity with refrigerant in the liquid-vapor state immediately prior to a restriction in fluid flow through the motor. In this manner, during a period of time immediately prior to flow restriction, liquid refrigerant flows into the reservoir at about the same rate that it flows out of the reservoir. However, during a period of time prior to flow restriction, the amount of fluid flowing into the reservoir will be less than the amount of fluid flow out of the reservoir.

During a period of time after the flow of refrigerant into the motor begins to be restricted, liquid refrigerant flows into the reservoir at a rate equal to or greater than the rate at which liquid refrigerant flows out of the reservoir. Thus, refrigerant continues to flow towards the energy recovery device, although the rate of flow towards the recovery device may be reduced in comparison to the rate of flow when the flow is not restricted. That is, refrigerant flow into the sound suppression device can be continuous during steady state operation of the air conditioner, and/or can at least continue for a sufficient period of time after the flow is restricted. Further, refrigerant flow from the condenser can be continuous as well, and/or can at least continue for a sufficient period of time after the flow is restricted. Therefore, it is believed that because the flow towards the energy recovery device does not stop or is not substantially reduced immediately after the flow through the motor is stopped or substantially reduced, the sounds associated with the operation of the energy recovery device are reduced. Of course, the inverse would be applicable as well in regard to when the flow through the motor is increased. It is noted here that a pressure regulator as is known in the art may be used to practice the present invention.

It is noted here that the present invention may be practiced with a reservoir that, after flow through the motor is restricted or stopped, does not become entirely filled with liquid refrigerant. However, the present invention may be practiced with a reservoir that becomes nearly filled or entirely filled with liquid refrigerant as well.

It is further noted that the present invention may be practiced without a reservoir. By way of example only and not by way of limitation, a sound suppression device that keeps the flow from being abruptly stopped or abruptly restricted upstream from the valve will be sufficient to practice the present invention, such as an enclosure with expandable walls (e.g. rubber tubing) that would serve to absorb the shock of closing the valve to some extent.

It is also noted that the present invention may be practiced by any means that enable the sudden increase in pressure upstream of the valve to be eliminated or at least substantially reduced in comparison to operating the energy recovery device without the sound suppression system.

In another embodiment of the present invention, combinable with or integral with the reservoir or other means to eliminate or reduce the increase in pressure (either temporally or in total), the sound suppression device comprises an orifice, as discussed above. It is noted that the orifice can be used without the reservoir as well. It is believed that the sound is reduced in this embodiment because the orifice dampens any pressure pulses or shock waves that propagate upstream from the energy recovery device. It is believed that when the pulse or wave reaches the orifice, the energy of the pulse or wave is eliminated or substantially reduced or at least redirected. Thus, by providing a small opening (in comparison to, say, the refrigerant piping from the compressor) for the pressure pulses or the shock waves to be transmitted through, the sound associated with the energy recovery device is reduced or eliminated.

In the preferred embodiment of the present invention, the sound reduction device is positioned very close to the energy recovery device, and as close to the valve and/or the motor as possible, and, depending on the configuration, is attached to the motor and/or the valve. However, the sound reduction device can be placed a substantial distance upstream from the energy recovery device, although this may slightly or even significantly inhibit (depending on the arrangement) the performance of the sound reduction device. In regard to the individual components of the sound reduction device, including but not limited to the reservoir and the orifice, the preferred embodiment of the present invention locates the orifice upstream from the reservoir, and most preferably immediately upstream from the reservoir. The orifice can even be made integral with the reservoir. Further, it is possible that the valve of the energy recovery device can be made integral with the reservoir. In embodiments where the valve is positioned downstream of the motor, the orifice of the sound reduction device can be adapted to also serve as the expansion valve or orifice positioned immediately upstream of the motor 110, or upstream from the reservoir 72.

The sound suppression device is usable with any of the configurations described in U.S. Pat. No. 6,272,871, as well variations, modifications, and improvements thereof. The sound suppression device is also usable with other air conditioning systems not addressed by the U.S. Pat. No. 6,272,871 patent but that have a fluid flow that is suddenly started and/or suddenly stopped and/or suddenly restricted and/or suddenly increased. It is further noted that the present invention can be used to reduce the energy associated with non-audible forces resulting from the sudden start or sudden stop of fluid flow. It is additionally noted that the present invention is not limited in quantity to the single occurrence of a given components. By way of example and not by way of limitation, the present invention could be practiced with two or more reservoirs, or two or more evaporators, or two or more heat removal devices, etc. Finally, it is noted that the present invention can be practiced in single phase and transcritical refrigeration systems including a working fluid such as carbon dioxide, as well as systems using standard working fluids known to the art or as yet to be implemented or even discovered but are found to be usable in the art.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

What is claimed is:

1. An air conditioner comprising:

an evaporator that evaporates a cold refrigerant;

a heat removal device adapted to receive compressed refrigerant and remove heat from at least a portion of the compressed refrigerant;

an energy recovery device, wherein the energy recovery device comprises a motor, the motor being in fluid communication with the heat removal device and positioned downstream of the heat removal device and upstream of the evaporator; and a sound suppression device in fluid communication with the heat removal device and the motor and positioned upstream of the energy recovery device.

2. The air conditioner of claim 1, wherein the sound suppression device comprises a reservoir adapted to hold varying mass amounts of refrigerant.

3. The air conditioner of claim 2, wherein the reservoir is a high-pressure reservoir.

4. The air conditioner of claim 1, wherein the sound suppression device comprises an orifice adapted to suppress sound resulting from operation of the energy recovery device.

5. The air conditioner of claim 1, wherein the sound suppression device comprises an orifice adapted to dampen a pressure pulse or a pressure wave propagating from a location at or upstream from the energy recovery device and downstream from the sound suppression device.

6. The air conditioner of claim 2, wherein the sound suppression device further comprises an orifice in fluid communication with the heat removal device and the reservoir.

7. The air conditioner of claim 6, wherein the orifice is positioned upstream of the reservoir.

8. The air conditioner of claim 7, wherein the orifice is integral with the reservoir.

9. The air conditioner of claim 1, wherein the energy recovery device is adapted to pulsatingly control the flow of refrigerant through the motor.

10. The air conditioner of claim 9, wherein refrigerant flow into the sound suppression device is continuous during steady-state operation of the air conditioner.

11. The air conditioner of claim 9, wherein refrigerant flow from the heat removal device is continuous.

12. The air conditioner of claim 9, wherein refrigerant flows into the sound suppression device after the refrigerant flow is substantially restricted from flowing to the motor.

13. The air conditioner of claim 9, wherein refrigerant flows into the sound suppression device after the refrigerant flow is substantially restricted from flowing from the motor.

14. The air conditioner of claim 9, wherein the sound suppression device is adapted to prevent a sudden increase in refrigerant pressure upstream from the energy recovery device when the energy recovery device pulsatingly controls the flow of refrigerant through the motor.

15. The air conditioner of claim 9, wherein energy of a pressure pulse created by the energy recovery device resulting from the energy recovery device pulsatingly controlling the flow of refrigerant through the motor is substantially reduced.

16. The air conditioner of claim 9, wherein the time for the pressure to rise at a location upstream from the energy recovery device and downstream from the heat removal device when the energy recovery device pulsatingly controls the flow of refrigerant through the motor is substantially extended.

17. The air conditioner of claim 1, wherein the sound suppression device reduces water hammer.

18. The air conditioner of claim 17, wherein the sound suppression device substantially reduces water hammer noise.

19. The air conditioner of claim 9, wherein the sound suppression device substantially absorbs the energy of a pressure pulse created when the energy recovery device pulsatingly controls the flow of refrigerant through the motor.

20. The air conditioner of claim 19, wherein the sound suppression device comprises a reservoir, wherein the reservoir is filled with refrigerant, the refrigerant being in at least one of a liquid and a liquid-vapor state.

21. The air conditioner of claim 9, wherein the sound suppression device comprises a pressure regulator.

22. The air conditioner of claim 1, wherein the sound suppression device decreases the rate of pressure increase of the refrigerant at a location upstream from the energy recovery device and downstream from the heat removal device as compared to the rate of pressure increase in an air conditioner without the sound suppression device.

23. An air conditioner comprising:

an evaporator that evaporates a cold refrigerant to a vapor phase;

a main compressor connected to the evaporator so that the compressor receives the vapor-phase refrigerant from the evaporator and compresses the vapor-phase refrigerant;

a heat removal device connected to the compressor so that the heat removal device receives the compressed refrigerant from the compressor and removes heat from the refrigerant;

an energy recovery device connected to the heat removal device and the evaporator so that the compressed and cooled refrigerant is passed through the energy recovery device; and a sound suppression device in fluid communication with the heat removal device and the energy recovery device and positioned upstream of the energy recovery device;

wherein the energy recovery device includes:

a motor located downstream of the heat removal device and upstream of the evaporator; and a regulator that passes the compressed and cooled refrigerant into the motor and maintains the refrigerant in the motor in a high cavitation region, while maintaining refrigerant within a predetermined refrigerant pressure range in the motor, wherein the regulator releases the refrigerant to the evaporator in a first saturated liquid-vapor phase having a higher vapor content than the refrigerant exiting the heat removal device.

24. An air conditioner according to claim 23, wherein the regulator comprises:

a valve located adjacent the motor, the valve opening and closing flow of refrigerant through the motor; and a controller for opening and closing the valve based on the pressure of the refrigerant downstream of the motor and upstream of the evaporator to regulate the refrigerant flowing into the motor and maintain the refrigerant in a high cavitation region within the motor, while maintaining refrigerant within the predetermined refrigerant pressure range in the motor.

25. A method of suppressing sound resulting from recovering energy from an air conditioner having an evaporator that evaporates a cold expanded refrigerant, a heat removal device adapted to receive compressed refrigerant from a compressor and remove heat from at least a portion of the compressed refrigerant, and an energy recovery device having a motor, the method comprising:

providing a sound suppression device in fluid communication with the heat removal device and the energy recovery device and positioned upstream of the energy recovery device;

passing the cooled refrigerant through the motor;

regulating the flow of the refrigerant through the motor and maintaining the refrigerant in a high cavitation region within the motor; and suppressing sounds resulting from the regulation of the flow of the refrigerant.

26. The method of suppressing sound according to claim 25, wherein the sounds are suppressed by dampening pressure pulses or pressure waves resulting from the regulation of the flow of the refrigerant.

27. The method of suppressing sound according to claim 25, wherein the sounds are suppressed by enabling flow into the sound suppression device to be continuous.

28. The method of suppressing sound according to claim 25, wherein the sounds are suppressed by enabling flow into the sound suppression device to continue after the flow through the motor is restricted.

29. The method of suppressing sound according to claim 25, wherein the rate of pressure increase of the refrigerant at a location upstream from the energy recovery device and downstream from the heat removal device is decreased as compared to the rate of pressure increase in an air conditioner without the sound suppression device.

30. The method of suppressing sound according to claim 26, wherein the sounds are suppressed by enabling flow from the heat removal device to be substantially continuous.

31. The method of suppressing sound according to claim 26, wherein the sounds are suppressed by preventing a sudden increase in refrigerant pressure upstream from the energy recovery device when the flow of refrigerant is regulated.

32. An air conditioner comprising:

an evaporator that evaporates a cold refrigerant;

a heat removal device adapted to receive compressed refrigerant and remove heat from at least a portion of the compressed refrigerant;

a flow restriction device adapted to abruptly decrease the flow of refrigerant from the heat removal device towards the evaporator at a location between the heat removal device and the evaporator; and a sound suppression device in fluid communication with the heat removal device and the evaporator and positioned upstream of the flow restriction device and downstream of the heat removal device.

33. The air conditioner of claim 32, wherein refrigerant flows into the sound suppression device after refrigerant flow is substantially restricted from flowing towards the evaporator.

34. The air conditioner of claim 32, wherein the sound suppression device is adapted to prevent a sudden increase in refrigerant pressure upstream from the flow restriction device when the flow restriction device restricts the flow of refrigerant towards the evaporator.

35. The air conditioner of claim 32, wherein energy of a pressure pulse created by the flow restriction device resulting from the flow restriction device restricting the flow of refrigerant towards the evaporator is substantially reduced.

36. The air conditioner of claim 32, wherein the time for the pressure to rise at a location upstream from the flow restriction device and downstream from the heat removal device when the flow restriction device restricts the flow of refrigerant towards the evaporator is substantially extended.

* * * * *